US010758102B2

(12) United States Patent
Lindenbeck

(10) Patent No.: US 10,758,102 B2
(45) Date of Patent: Sep. 1, 2020

(54) WET-CLEANING APPLIANCE HAVING A ROTATABLE CLEANING ROLLER

(71) Applicant: Vorwerk & Co. Interholding GmbH, Wuppertal (DE)

(72) Inventor: Bernd Lindenbeck, Leverkusen (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 0 days.

(21) Appl. No.: 16/312,460

(22) PCT Filed: Jun. 16, 2017

(86) PCT No.: PCT/EP2017/064748
§ 371 (c)(1),
(2) Date: Dec. 21, 2018

(87) PCT Pub. No.: WO2018/001754
PCT Pub. Date: Jan. 4, 2018

(65) Prior Publication Data

US 2019/0125155 A1 May 2, 2019

(30) Foreign Application Priority Data

Jun. 28, 2016 (DE) ..... 10 2016 111 808

(51) Int. Cl.
*A47L 11/08* (2006.01)
*A47L 13/22* (2006.01)
(Continued)

(52) U.S. Cl.
CPC ..... *A47L 11/085* (2013.01); *A47L 11/145* (2013.01); *A47L 11/19* (2013.01); *A47L 11/282* (2013.01);
(Continued)

(58) Field of Classification Search
CPC ..... A47L 13/22; A47L 13/23; A47L 11/03; A47L 11/085; A47L 11/145;
(Continued)

(56) References Cited

U.S. PATENT DOCUMENTS 1,536,687 A 5/1925 Oatey
4,173,054 A * 11/1979 Ando ..... A47L 11/292 15/98
(Continued)

FOREIGN PATENT DOCUMENTS

DE 102 29 611 B3 1/2004
DE 20 2009 013 434 U1 12/2009
(Continued)

OTHER PUBLICATIONS

International Search Report of PCT/EP2017/064359, dated Sep. 5, 2017.
(Continued)

*Primary Examiner* — Mark Spisich
(74) *Attorney, Agent, or Firm* — Collard & Roe, P.C.

(57) ABSTRACT

A wet-cleaning appliance, in particular a wet mop, has a cleaning roller, which can be rotated about a roller axis, and having a wetting device for applying a liquid to the cleaning roller. In order to provide for regeneration of the cleaning roller with the best possible result, it is proposed that the wet-cleaning appliance should have a wiper device, in particular a wiper lip, which can be displaced onto the cleaning roller and is intended for assisting in removing liquid and/or dirt from the cleaning roller and/or for assisting in applying liquid to the cleaning roller.

10 Claims, 6 Drawing Sheets

(51) Int. Cl.

| | |
|---|---|
| ***A47L 11/19*** | (2006.01) |
| ***A47L 11/282*** | (2006.01) |
| ***A47L 11/40*** | (2006.01) |
| ***A47L 11/292*** | (2006.01) |
| ***A47L 11/14*** | (2006.01) |

(52) U.S. Cl.
CPC ..... *A47L 11/292* (2013.01); *A47L 11/408* (2013.01); *A47L 11/4016* (2013.01); *A47L 11/4041* (2013.01); *A47L 11/4088* (2013.01); *A47L 13/22* (2013.01)

(58) Field of Classification Search
CPC ..... A47L 11/185; A47L 11/26; A47L 11/28; A47L 11/282; A47L 11/29; A47L 11/292; A47L 11/4013; A47L 11/4016; A47L 11/4041; A47L 11/408; A47L 11/4083; A47L 11/4088
USPC ..... 15/98, 103.5
See application file for complete search history.

(56) References Cited

U.S. PATENT DOCUMENTS

| | | | | |
|---|---|---|---|---|
| 4,875,246 | A | 10/1989 | MacGregor | |
| 5,657,503 | A * | 8/1997 | Caruso ..... | A47L 11/03 15/97.1 |
| 5,657,504 | A | 8/1997 | Khoury | |
| 9,289,105 | B2 | 3/2016 | Moes | |
| 2007/0011838 | A1 | 1/2007 | Davis et al. | |

FOREIGN PATENT DOCUMENTS

| | | |
|---|---|---|
| DE | 10 2014 119 188 A1 | 6/2016 |
| EP | 0 898 924 A1 | 3/1999 |

OTHER PUBLICATIONS

International Search Report of PCT/EP2017/064748, dated Sep. 22, 2017.
International Search Report of PCT/EP2017/064357, dated Oct. 16, 2017.
International Search Report of PCT/EP2017/064365, dated Sep. 20, 2017.
International Search Report of PCT/EP2017/064745, dated Sep. 20, 2017.

* cited by examiner 23
22
1
20
8
21
19
r
2
3

WET-CLEANING APPLIANCE HAVING A ROTATABLE CLEANING ROLLER

CROSS REFERENCE TO RELATED APPLICATIONS

This application is the National Stage of PCT/EP2017/064748 filed on Jun. 16, 2017, which claims priority under 35 U.S.C. § 119 of German Application No. 10 2016 111 808.7 filed on Jun. 18, 2016, the disclosures of which are incorporated by reference. The international application under PCT article 21(2) was not published in English.

TECHNICAL FIELD

The invention pertains to a wet-cleaning appliance, particularly a wet mop, with a cleaning roller that can be rotated about a roller axis and with a wetting device for applying a liquid to the cleaning roller.

The invention furthermore pertains to a method for operating a wet-cleaning appliance, particularly a wet mop.

PRIOR ART

Wet-cleaning appliances and methods for operating a wet-cleaning appliance are known from the prior art.

For example, DE 102 29 611 B3 discloses a wet-cleaning appliance with a mop body that can be driven so as to rotate about a rotational axis, wherein a cleaning liquid is withdrawn from a storage tank and sprayed on the surface of the mop body by means of spray nozzles that are arranged in the direction of the rotational axis of the mop body. In a mopping mode, the thusly wetted mop body is moved over a surface to be cleaned, wherein the mop body picks up dirt from the surface to be cleaned.

In the mopping mode, the mop body is increasingly covered with dirt such that a regeneration of the mop body is required. To this end, the mop body is lifted off the surface to be cleaned, enclosed by a housing and sprayed with unused cleaning liquid. The mop body rotates such that cleaning liquid and dirt are expelled from the mop body, wherein the cleaning liquid and the dirt impinge on the inside of the housing and are transferred into a receiving tank.

In addition, U.S. Pat. No. 4,875,246 A discloses a wet-cleaning appliance with a mop body that can be driven so as to rotate about a rotational axis, a wring-out roller and a wetting device. The wring-out roller can be displaced relative to the rotationally driven mop body from an active position into an inactive position.

Furthermore, publication U.S. Pat. No. 1,536,687 A discloses a wet-cleaning appliance with a mop body that can be driven so as to rotate about a rotational axis, wherein a guide plate is assigned to said mop body and transports material from the mop body into a collection container.

SUMMARY OF THE INVENTION

Based on the aforementioned prior art, the invention aims to enhance a wet-cleaning appliance of the aforementioned type in such a way that the cleaning roller can be regenerated with the best possible result, particularly within a shorter regeneration time and with a reduced input of liquid. Furthermore, the invention also aims to alternatively or additionally enhance the wet-cleaning appliance with respect to the application of liquid to the cleaning roller.

In order to attain the above-defined objective, it is proposed that the wet-cleaning appliance comprises a wiper device, particularly a wiper lip, which can be displaced onto the cleaning roller in order to assist in removing liquid and/or dirt from the cleaning roller and/or to assist in applying liquid to the cleaning roller, wherein the wetting device and the wiper device are parts of a common functional unit, which can be displaced as a whole relative to the cleaning roller, such that the functional unit can be displaced as a whole from a first operating position into a second operating position and vice versa.

Consequently, the inventive wiper device can basically perform two tasks.

The wiper device, which can be displaced onto the cleaning roller, can on the one hand improve wetting of the cleaning roller. The cleaning roller is usually provided with a textile cleaning layer, between the fibers of which liquid can be absorbed and stored. If the wiper device is displaced onto the cleaning roller in such a way that it only contacts part of the fiber length, the wiper device can press liquid between the fibers of the cleaning roller without once again releasing said liquid from the cleaning layer due to the passage of the wiper device over the fibers during the further rotation of the cleaning roller.

The wiper device can furthermore serve for removing the liquid and/or for removing dirt from the cleaning roller. To this end, the wiper device is displaced onto the cleaning roller in such a way that it presses against the cleaning roller with a certain contact pressure and preferably wipes the liquid off the cleaning roller mechanically. Due to this wiping action, the liquid, as well as the picked up dirt, is respectively pressed out and wiped off the material of the cleaning roller such that the regeneration result is improved in comparison with the prior art. The dirt is also respectively spun off the cleaning roller and the wiper device due to the rotation of the cleaning roller and can be transported to a collection container. Consequently, the cleaning effect is on the one hand achieved by spinning the liquid/the dirt off the rotating cleaning roller and on the other hand by the wiping action, during which liquid and dirt respectively are, if applicable, pressed out of the cleaning roller. The invention also utilizes the effect that fibers or bristles of the cleaning layer, which are bent by the wiper device during the rotation of the cleaning element, are once again set upright after passing the wiper device due to their internal stress and the applied centrifugal force. This additionally assists in spinning off the liquid and the dirt, respectively.

The wiper device advantageously extends over the entire axial length of the cleaning roller such that the entire circumferential surface of the cleaning roller can be respectively regenerated and wetted during one complete rotation of the cleaning roller.

In the context of the invention, the wet-cleaning appliance may be a wet-cleaning appliance that is hand-operated by a user or a self-traveling wet-cleaning appliance, for example a robotic mop. Furthermore, wet-cleaning appliances in the context of the invention may also have a vacuuming function and a mopping function and be realized, for example, in the form of combined vacuuming-mopping appliances.

It is proposed that the wetting device and the wiper device are parts of a common functional unit. Consequently, this functional unit on the one hand performs the task of wetting the cleaning roller and on the other hand the task of wiping liquid and dirt off the cleaning roller. The wiper device likewise performs the aforementioned task of incorporating the liquid into a cleaning layer of the cleaning roller when it is correspondingly spaced apart from the surface of the cleaning roller. The design in the form of a common functional unit also has the advantage that the functional unit can be installed into the wet-cleaning appliance as a whole such that fewer installation steps are required for the manufacture and the installation time can be reduced accordingly. In addition, the functional unit also requires less structural space within the wet-cleaning appliance because fewer fastening means and the like are needed. Furthermore, a common housing can be designed smaller than two individual housings that are arranged adjacent to one another and respectively serve for accommodating the wetting device and the wiper device. In the context of a common functional unit, it would be conceivable to realize variations, in which the wetting device and the wiper device are realized in one piece, for example in the form of a common injection-molded plastic part, as well as variations, in which the wetting device and the wiper device are fastened on one another in order to form a common functional unit such that both devices can be jointly installed into the wet-cleaning appliance. It is particularly advantageous if the common functional unit—and therefore also the wetting device and the wiper device—extends along the entire longitudinal extent of the cleaning roller such that the cleaning roller can be uniformly wetted and wiped off over its length. In this case, the functional unit is arranged on the housing of the wet-cleaning appliance in a displaceable manner such that it can be displaced relative to the cleaning roller as a whole with a single displacement motion. Consequently, the functional unit can be very easily and quickly displaced from a position for a mopping mode into a position for a regeneration mode.

It is furthermore proposed that the wiper device and/or the functional unit are mounted on a housing of the wet-cleaning appliance so as to be pivotable about a pivoting axis arranged parallel to the cleaning roller, wherein the wiper device and/or the functional unit are particularly subjected to a spring force acting in the direction of the cleaning roller. In this way, the wiper device or the functional unit can be respectively pivoted from a mopping position into a regeneration position, i.e. either pivoted away from the cleaning roller or pivoted against the cleaning roller, wherein the wiper device comes in mechanical contact with the cleaning roller in the latter instance. In order to respectively press the wiper device or the functional unit against the cleaning roller with the highest possible force in its position, in which it is pivoted against the cleaning roller, an actuating device engaging on the wiper device or the functional unit advantageously comprises a spring that presses the wiper device against the cleaning roller. In addition, a tolerance compensation for possible diameter fluctuations of the cleaning roller, floor irregularities or the like can be achieved by means of the spring action. The actuating device may comprise, for example, a torsion spring drive with a coil spring.

It is proposed that a displacement drive is assigned to the wiper device and/or the functional unit and designed for displacing the wiper device and/or the functional unit relative to the cleaning roller. Consequently, the wet-cleaning appliance not only comprises, if applicable, a spring for exerting a suitable contact pressure for the regeneration upon the cleaning roller, but also a displacement drive, for example in the form of a linear drive or a pivot drive, which can displace the wiper device and/or the functional unit relative to the cleaning roller. In this case, it is preferred that the displacement drive can respectively displace the wiper device or the functional unit in multiple stages. The first stage may be a position of the wiper device, in which it is completely separated from the cleaning roller. A second position may be configured such that the wiper device only contacts an outermost free end region of the fibers of a cleaning layer of the cleaning roller. A third position may ultimately be characterized in that the wiper device presses against the cleaning roller with the highest possible force. The latter particularly takes place in conjunction with the spring force of the above-proposed spring.

It is furthermore proposed that the wet-cleaning appliance comprises a displaceable cover element for completing a roller cover, which encloses the cleaning roller and, in particular, also the wetting device and the wiper device, in a shape-corresponding manner in the circumferential direction of the cleaning roller, wherein the cover element is designed for selectively uncovering and/or closing an opening region of the roller cover. The roller cover extends along the entire length of the cleaning roller and, with the exception of the opening region, preferably encloses the cleaning roller completely in the circumferential direction. The cover element serves as a closure element for closing the opening region for a regeneration mode of the wet-cleaning appliance such that liquid, which is respectively removed from or spun off the cleaning roller, cannot escape outward and come in contact with a user of the wet-cleaning appliance. Furthermore, the situational closing of the opening region by means of the cover element also makes it possible to realize a drip detection while the cleaning appliance is transported or in a parked position. It is particularly advantageous if the wetting device and the wiper device, which are preferably realized in the form of a common functional unit, are also arranged within the roller cover in addition to the cleaning roller. The roller cover therefore is an external encapsulation for the cleaning roller, as well as for all liquid-carrying elements, such that the environment is optimally shielded from splashing or dripping liquid.

The cleaning roller is advantageously arranged on the wet-cleaning appliance so as to be displaceable relative to the roller cover such that the cleaning roller protrudes from the roller cover and can come in contact with a surface to be cleaned during a mopping mode of the wet-cleaning appliance whereas the cleaning roller is displaced into the roller cover during a regeneration mode, in which the opening region of the roller cover is closed by means of the cover element.

It is advantageous if the roller cover can be completely separated from the housing of the wet-cleaning appliance such that the wiper device and/or the entire functional unit can likewise be separated from the wet-cleaning appliance. Furthermore, it is naturally also possible to respectively separate the wiper device or the functional unit from the roller cover.

It is proposed that the cover element is functionally connected to a displacement drive of the wiper device and/or the functional unit in such a way that the wiper device and/or the functional unit can be displaced toward the cleaning roller during a displacement of the cover element in the direction of a position, in which it closes the roller cover. For example, the displacements of the cover element and the wiper device/functional unit required for a regeneration mode of the wet-cleaning appliance are thereby particularly carried out simultaneously prior to the regeneration mode, namely in order to close the roller cover by means of the cover element on the one hand and to displace the wiper device in the direction of the cleaning roller on the other hand. Consequently, the user of the wet-cleaning appliance does not have to manipulate multiple actuating devices or switches prior to a regeneration mode. In fact, closing of the roller cover causes a displacement of the wiper device/functional unit or vice versa. The cover element and the wiper device or the functional unit are advantageously connected to one another by means of a gearing, for example by means of coupled gearwheels.

It is furthermore proposed that the wiper device empties into a disposal channel for discharging the liquid into a liquid container. For example, a liquid collection region for the liquid removed from the cleaning roller by means of the wiper device is assigned to the wiper device and directly connected to the disposal channel for discharging the liquid into the liquid container. In this way, the liquid and/or the dirt, which is respectively wiped or spun off the cleaning roller, can directly enter the disposal channel without being spun around or the like within the roller cover.

It is furthermore proposed that the wetting device, particularly the common functional unit, comprises a distribution device with a plurality of outlet openings and/or a liquid supply line for supplying the wetting device with liquid. The wetting device serves for making available and distributing liquid. The distribution of the liquid over the length of the cleaning roller advantageously takes place through a plurality of outlet openings that allow virtually homogenous wetting of the cleaning roller along its longitudinal extent. The distribution device may comprise mere outlet openings or be provided with nozzles for applying liquid to the surface of the cleaning roller. The liquid supplied to the wetting device via the liquid supply line is advantageously under pressure such that it can be sprayed on the cleaning roller in small quantities and no complete soaking of the cleaning roller material takes place. The liquid supply line can be connected to a liquid reservoir of the wet-cleaning appliance.

It is also proposed that the distribution device comprises an air conduction device, which is oriented in the direction of the cleaning roller, in order to conduct air in the direction of a disposal channel and to thereby discharge the liquid into a collection container. The air accelerated within the roller cover due to the rotation of the cleaning roller is conducted in the direction of the disposal channel by the air conduction device in order to thereby assist in transporting the liquid in the direction of the collection container. The air conduction device may advantageously comprise a plurality of air conduction ribs on the outer side of the distribution device, wherein said air conduction ribs are oriented in the circumferential direction of the cleaning roller.

In addition to the above-described wet-cleaning appliance, the invention also proposes a method for operating a wet-cleaning appliance, particularly an above-described wet-cleaning appliance, wherein liquid and/or dirt are removed from a cleaning roller of the wet-cleaning appliance during a regeneration mode, wherein a wiper device, which can be displaced relative to the cleaning roller, is placed onto the cleaning roller in order to regenerate the cleaning roller, and wherein the cleaning roller is accelerated in comparison with a normal rotational speed during a mopping mode of the wet-cleaning appliance and liquid and/or dirt, which is spun off the cleaning roller, and/or liquid and/or dirt, which is removed by the wiper device, is collected and transported into a collection container.

The invention furthermore proposes a method for operating a wet-cleaning appliance, wherein liquid is applied to a rotatable cleaning roller by means of a wetting device, wherein a wiper device, which can be displaced relative to the cleaning roller, is displaced toward the cleaning roller in order to wet the cleaning roller, wherein the wiper device is spaced apart from the cleaning roller such that the wiper device only contacts a partial end region of the fibers of a cleaning layer of the cleaning roller, and wherein the wiper device conducts liquid between the fibers during the rotation of the cleaning roller.

The regeneration mode of the wet-cleaning appliance particularly comprises the steps of accelerating the cleaning roller, placing the wiper device onto the cleaning roller, wiping dirt and/or liquid off the cleaning roller by means of the wiper device and radially spinning liquid and/or dirt off the cleaning roller, as well as collecting and transporting the liquid and the dirt into a disposal channel for respectively discharging the liquid and the dirt into a collection container.

In order to ensure sufficient wetting of the cleaning roller, for example prior to a mopping mode, the liquid supply or liquid distribution is configured such that the wiper device, particularly the functional unit, is moved toward the cleaning roller in such a way that the wiper device just barely contacts the fibers of a cleaning layer of the cleaning roller. The rotational speed of the cleaning roller is decelerated in comparison with the normal mopping mode while liquid is supplied to a plurality of outlet openings by means of the functional unit, particularly a distribution device, and then applied to the surface of the cleaning roller. The wiper device presses the liquid between the fibers of the cleaning roller, wherein the cleaning roller is advantageously wetted bit by bit in the circumferential direction over the course of one or more complete revolutions. After wetting of the cleaning roller has been completed, the wiper device or the functional unit is respectively spaced apart farther from the cleaning roller such that the cleaning roller rotates freely. For example, a mopping mode of the wet-cleaning appliance may subsequently take place.

In the context of the invention, the term wet-cleaning appliances basically refers to all appliances, which can perform a wet-cleaning task exclusively or additionally to other tasks. This includes hand-operated and self-traveling wet-cleaning appliances, particularly also cleaning robots, on the one hand and combined dry-cleaning and wet-cleaning appliances, which can perform a wet-cleaning task, as well as a dry-cleaning task, on the other hand. In the context of the invention, however, the term wet-cleaning appliances not only refers to conventional floor cleaning appliances for cleaning a floor, but also to wet-cleaning appliances for cleaning above-floor surfaces. These include, for example, appliances for cleaning windows and the like.

BRIEF DESCRIPTION OF THE DRAWINGS

The invention is described in greater detail below with reference to exemplary embodiments. In the drawings.

DESCRIPTION OF THE EMBODIMENTS

Figure 1:
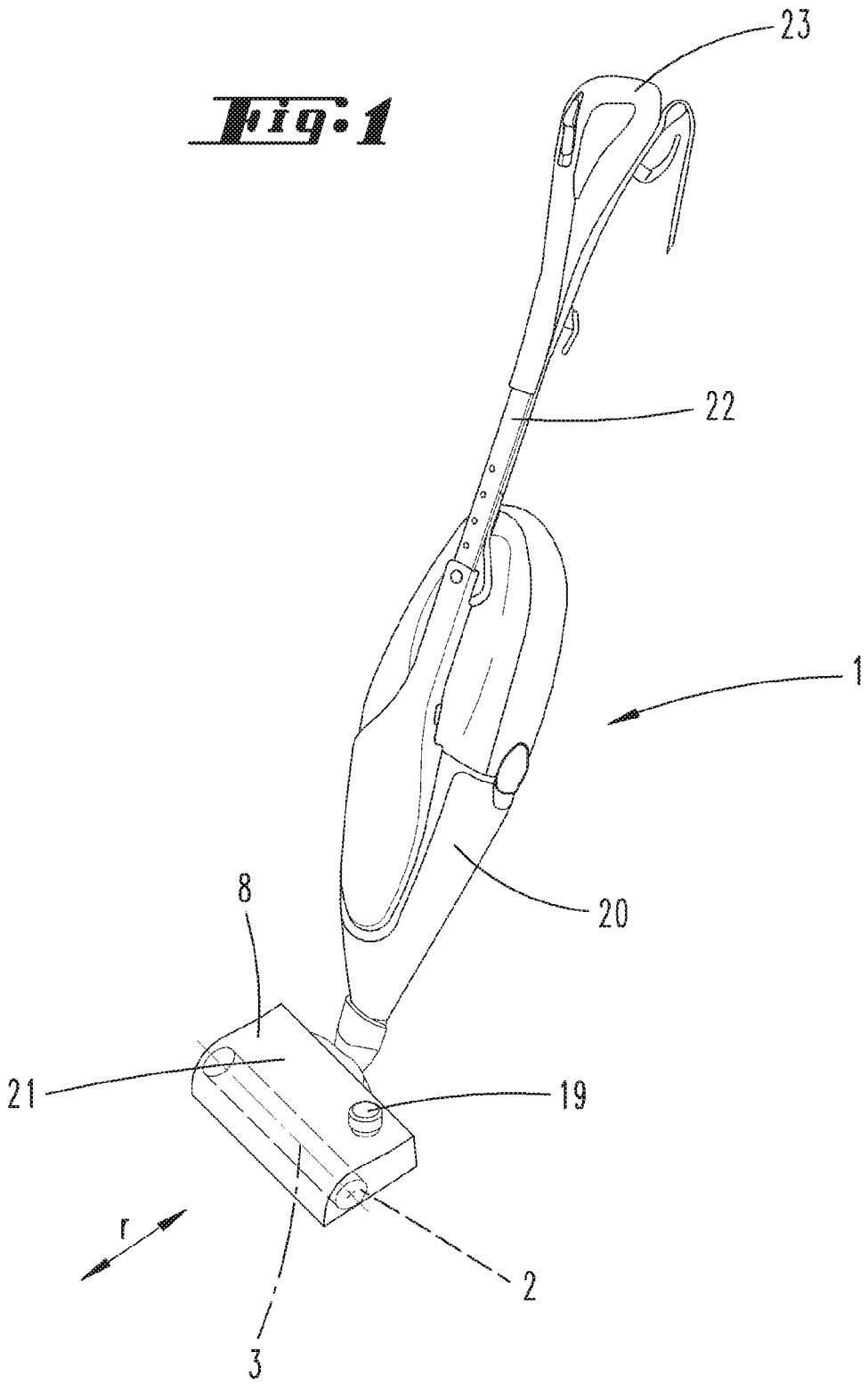
FIG. 1 shows an inventive wet-cleaning appliance.

FIG. 1 shows a wet-cleaning appliance 1, which is realized in the form of a hand-operated wet-cleaning appliance 1 with a base unit 20 and an attachment 21. The attachment 21 is removably held on the base unit 20. The base unit 20 comprises a shaft 22 that is realized, for example, in a telescoping manner such that a user of the wet-cleaning appliance 1 can adapt the length of the shaft 22 to his body size. Furthermore, a handle 23 is arranged on the shaft 22 and enables the user to operate the wet-cleaning appliance 1 during a normal mopping mode, i.e. to push the wet-cleaning appliance over a surface to be cleaned. During the mopping mode, the user usually moves the wet-cleaning appliance 1 over the surface to be cleaned in opposite moving directions r. In this case, the user pushes the wet-cleaning appliance 1 away from himself and pulls the wet-cleaning appliance toward himself in an alternating manner.

The attachment 21 comprises a housing, 8, in which a cleaning roller 2 is held. The housing 8 comprises a filler neck 19, through which liquid can be filled into a (not-shown) liquid reservoir. The water stored in the liquid reservoir serves for wetting the exterior of the cleaning roller 2.

The cleaning roller 2 is mounted within the housing 8 so as to be rotatable about a roller axis 3. During the mopping mode, the cleaning roller 2 rotates about the roller axis 3 such that the circumferential surface of the cleaning roller 2 continuously carries out a rolling motion on the surface to be cleaned. The cleaning roller 2 is usually wrapped with a cleaning layer, if applicable with interposition of a sponge body that stores additional liquid. In this example, the cleaning layer is a textile cleaning cloth, between the fibers of which liquid can also be absorbed.

During the mopping mode, dirt is continuously deposited on the cleaning roller 2, i.e. on the cleaning layer. Consequently, a regeneration of the cleaning roller 2 may be required after a certain operating period, wherein dirt and liquid containing dirt are removed from the cleaning roller 2 during a corresponding regeneration mode.

Figure 2:
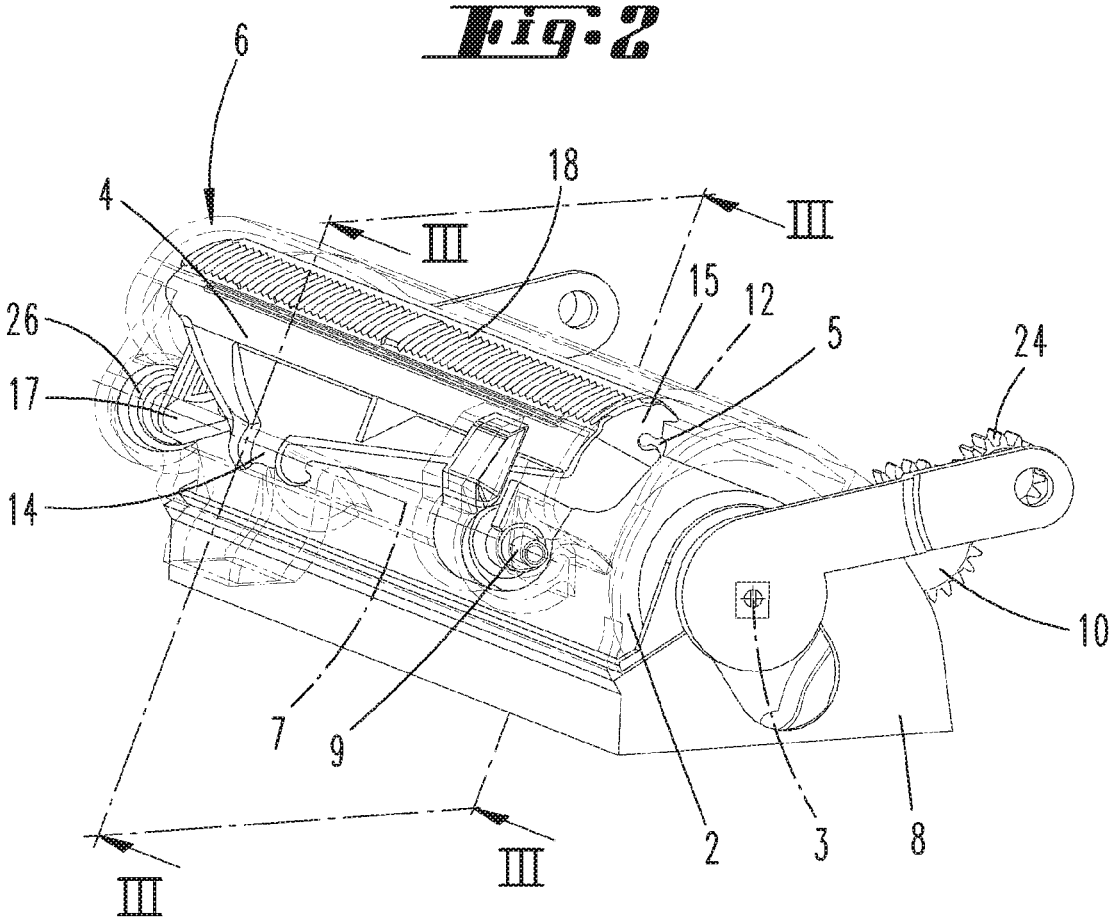
FIG. 2 shows a portion of the wet-cleaning appliance with an inventive functional unit in the form of an exposed perspective view.

FIG. 2 shows a portion of the housing 8 of the attachment 21, in which the cleaning roller 2 is held so as to be rotatable about the roller axis 3. In order to enhance the intelligibility, the portion of the housing 8 is illustrated in an exposed manner such that the internal characteristics are visible. A roller cover 12 is arranged on the housing 8 and semicircularly encloses the cleaning roller 2 over at least an angular range of about 180 degrees. The roller cover 12 can be removed from the housing 8 of the wet-cleaning appliance 1 such that optimal accessibility is provided, e.g. for servicing. Referred to the opposite circumferential side of the cleaning roller 2—viewed from the bottom in FIG. 2—the roller cover 12 has an opening region 13, through which the cleaning roller 2 can come in contact with the surface to be cleaned during a normal mopping mode. During a regeneration mode, the cleaning roller 2 is displaced into the housing 8 and the roller cover 12 and the opening region 13 are closed with a cover element 11 such that the cleaning roller 2 is completely encapsulated in the circumferential direction.

A functional unit 6 comprising a wetting device 4 and a wiper device 5 is arranged in the region enclosed by the roller cover 12. The functional unit 6 is mounted in the housing 8 so as to be pivotable about a pivoting axis 7 such that this functional unit can be pivoted relative to the surface of the cleaning roller 2, i.e. either toward the cleaning roller 2 or away from the cleaning roller 2. Furthermore, a displacement drive 10, in this case a gearwheel that forms part of a gearing, is assigned to the functional unit 6 and makes it possible to move the entire functional unit 6 away from the cleaning roller 2, particularly for a mopping mode of the wet-cleaning appliance 1, in which a sufficient clearance between the cleaning roller 2 and the functional unit 6 is required for ensuring the completely unobstructed rotatability of the cleaning roller 2. A cover drive 24, which interacts with the displacement drive 10, serves for displacing the cover element 11.

The wetting device 4 serves for wetting the cleaning roller 2. The wetting device 4 specifically comprises a liquid supply line 17, a distribution device 15 and a plurality of outlet openings 16 (see FIG. 7). The liquid supply line 17 serves for supplying liquid from a liquid reservoir of the wet-cleaning appliance 1 to the distribution device 15. The distribution device 15—as well as the entire functional unit 6 and therefore also the wetting device 4—extends over the entire longitudinal extent of the cleaning roller 2. The distribution device 15 essentially forms a liquid channel that extends along the longitudinal extent of the cleaning roller 2 and the channel wall of which comprises a plurality of outlet openings 16 for applying liquid to the cleaning roller 2. The liquid is advantageously pumped from the liquid reservoir into the liquid supply line 17 such that the liquid in the distribution device 15 is under pressure and can be sprayed on the surface of the cleaning roller 2 through the outlet openings 16. A fine spray mist, which is homogenous over the longitudinal extent of the cleaning roller 2 and leads to uniform wetting of the cleaning roller 2, can thereby be formed in dependence on the distance between adjacent outlet openings 16. The outlet openings 16 are arranged in a portion of the distribution device 15 that is located directly adjacent to the cleaning roller 2, namely on the upper right side of the functional unit 6 above the wiper device 5 in FIG. 2.

In the position of the wiper device 5, in which it is placed onto the cleaning roller 2, the wiper device can mechanically wipe liquid and dirt off the surface of the cleaning roller 2 during a regeneration mode of the wet-cleaning appliance 1. The wiper device 5 likewise extends over the entire length of the cleaning roller 2 such that it can wipe liquid and dirt off the cleaning roller 2 over its entire surface. Due to the rotation of the cleaning roller 2, the circumferential surface of the cleaning roller 2 is completely cleaned. The liquid wiped off the cleaning roller 2 is discharged into a disposal channel 14, which in the drawing is arranged underneath the wiper device 5 and empties, for example, into a (not-shown) collection container. An air conduction device 18 arranged on the functional unit 6, in this case on the distribution device 15, assists in respectively transporting the liquid through or into the disposal channel 14, wherein said air conduction device comprises a plurality of air conduction ribs that are oriented in the circumferential direction of the cleaning roller 2. The air accelerated due to the rotation of the cleaning roller 2 is conducted in the direction of the disposal channel 14 by means of the air conduction device 18.

The functional unit 6 is mounted in the housing 8 by means of a bearing 26 on the one hand and by means of an actuating device 9 on the other hand. The bearing 26 additionally connects the liquid supply line 17 to a liquid supply of the wet-cleaning appliance 1. The actuating device 7 serves for pressing the functional unit 6 against the cleaning roller 2. The actuating device 9 comprises a spring 25 for pressing the functional unit 6, particularly the wiper device 5, onto the surface of the cleaning roller 2 as described below with reference to FIG. 9.

Figure 3:
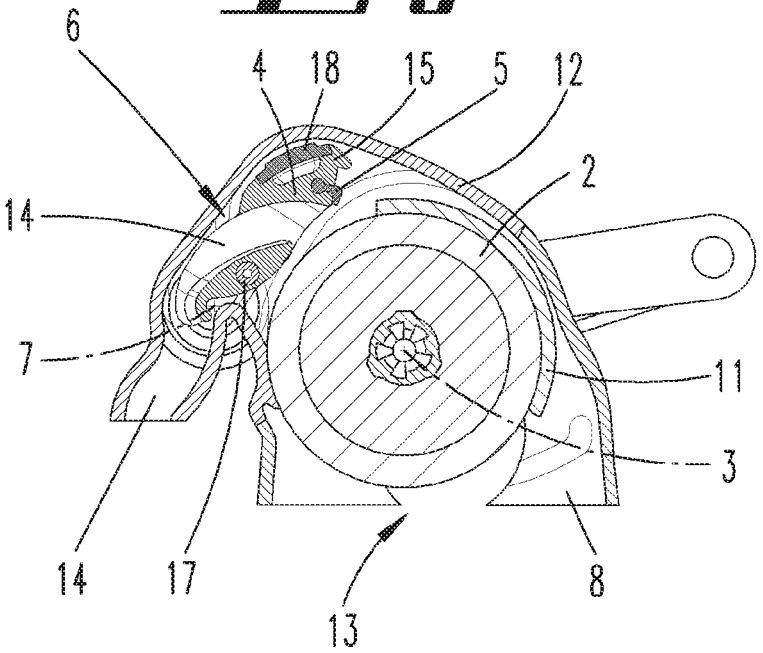
FIG. 3 shows a cross section through the portion of the wet-cleaning appliance according to FIG. 2.

FIG. 3 shows a cross section through the portion of the attachment 21 illustrated in FIG. 2. This figure shows the roller cover 12, which is arranged on the housing 8 and in which the functional unit 6 is removably accommodated. The opening region 13 of the roller cover 12, which is oriented in the direction of a surface to be cleaned, is opened in this case, i.e. uncovered by the displaceable cover element 11. The cover element 11 can be respectively pivoted into the opening region 13 and out of the opening region 13 of the roller cover 12 by means of a cover drive 24. This cover drive 24 is coupled to the displacement drive 10 for the functional unit 6 such that a displacement of the functional unit 6 onto the cleaning roller 2 takes place simultaneously with the displacement of the cover element 11 into the opening region 13. The functional unit 6 is pivotably held on the roller cover 12 by means of the pivoting axis 7.

Figure 4:
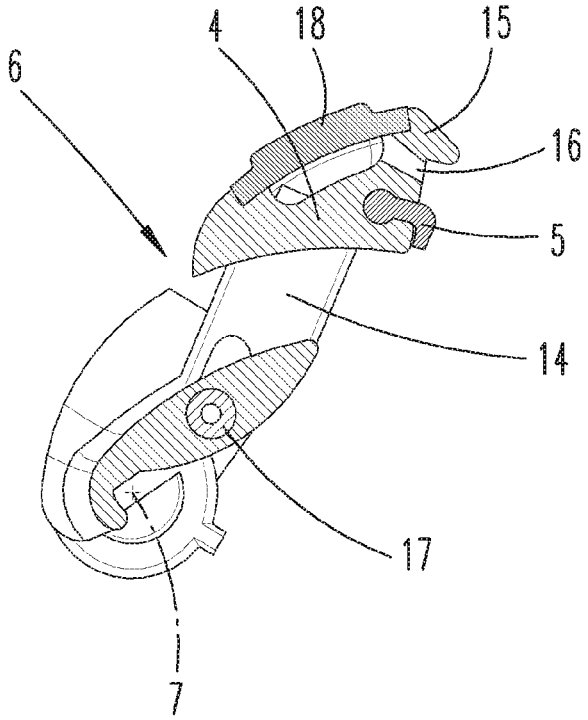
FIG. 4 shows the functional unit in the form of an enlarged view.

FIG. 4 shows an enlarged illustration of the functional unit 6 with the wetting device 4, the wiper device 5 and the disposal channel 14 for discharging the liquid collected by the wiper device 5.

Figure 5:
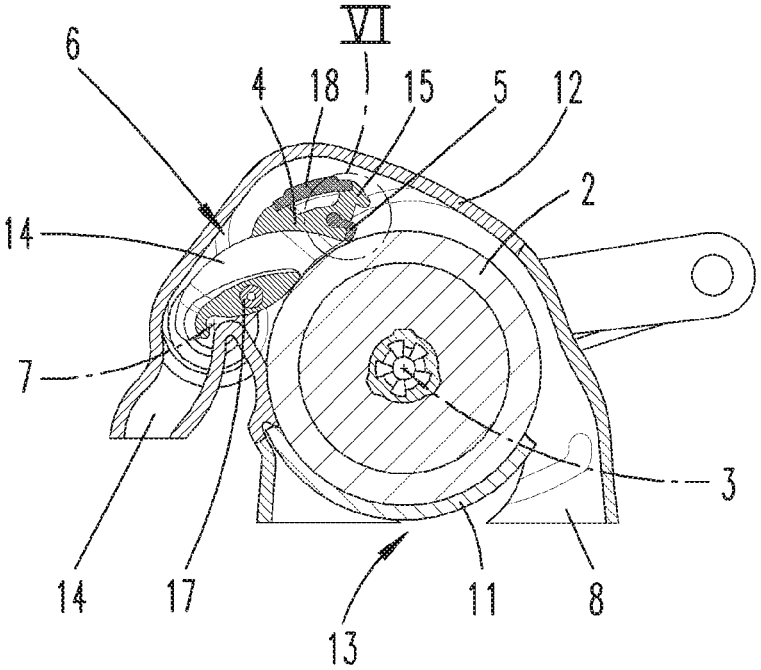
FIG. 5 shows the portion of the wet-cleaning appliance according to FIG. 3, wherein the functional unit is displaced against the cleaning roller.

FIG. 5 shows the portion of the attachment 21 according to FIG. 3, wherein the functional unit 6 is pivoted against the cleaning roller 2 and the opening region 13 is closed by the cover element 11. This corresponds to the position of the functional unit 6 during a regeneration mode of the cleaning roller 2. In this case, the cleaning roller 2 is completely encapsulated in the circumferential direction by the roller cover 12 and the cover element 11.

Figure 6:
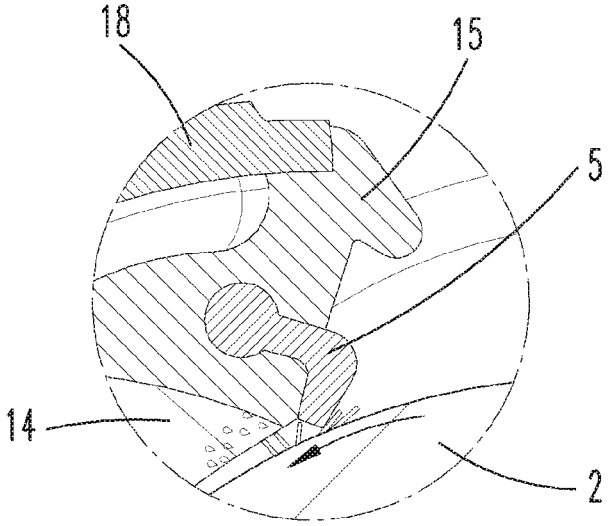
FIG. 6 shows a cleaning roller with a textile cleaning layer during its contact with a wiper device of the functional unit.

FIG. 6 shows an enlarged portion of FIG. 5. The functional unit 6 contacts the cleaning layer of the cleaning roller 2 with the wiper device 5. In this example, the cleaning layer is a textile layer with fibers that essentially protrude radially. In this case, the fibers are not drawn true-to-scale relative to the size of the cleaning roller 2—in order to enhance the intelligibility. For example, the fibers have a length of 1 mm to 10 mm. The fibers are bent and pressed against the cleaning roller 2 in the circumferential regions of the cleaning roller 2, which are currently in contact with the wiper device 5. In the figure, the cleaning roller 2 rotates in the counterclockwise direction. After passing the wiper device 5, the fibers are once again set upright because the wiper device 5 longer contacts this circumferential region. During the return motion from the pressed-down position into the upright position, liquid and/or dirt is spun off the fibers and directly transported to the disposal channel 14.

Figure 7:
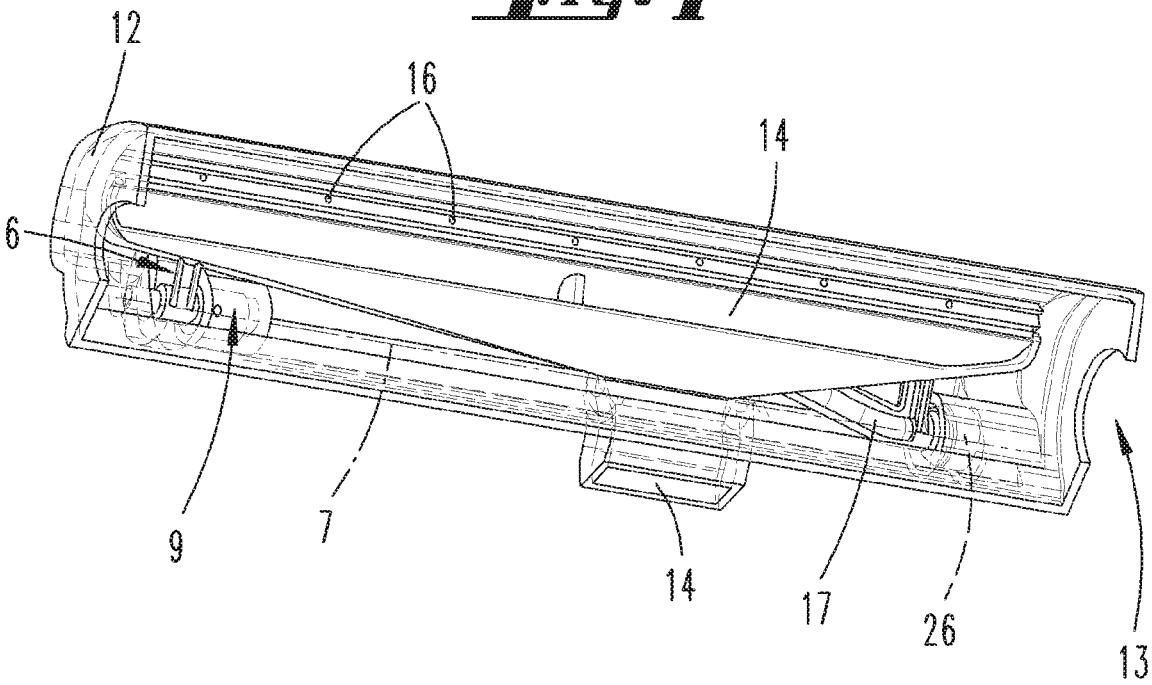
FIG. 7 shows a perspective view into a roller cover with a functional unit.

FIG. 7 shows the roller cover 12 illustrated in FIG. 2 with the functional unit 6 in the form of a view from the rear bottom side, i.e. as seen from a point on the surface of the cleaning roller 2. Among other things, this figure shows the bearing 26 and the actuating device 9, by means of which the functional unit 6 is held in the roller cover 12 so as to be pivotable about a pivoting axis 7. The bearing 26 is connected to the liquid supply line 17 that empties into the distribution device 15 of the wetting device 4. Liquid can therefore be transported from a liquid reservoir into the liquid supply line 17 through the bearing 26 and ultimately into the distribution device 15. The liquid can subsequently escape in the direction of the cleaning roller 2 through the outlet openings 16 of the distribution device 15.

The wiper device 5 is arranged underneath the outlet openings 16 (referred to the illustration according to FIG. 7). During a regeneration mode of the wet-cleaning appliance 1, the wiper device 5 presses against the surface of the cleaning roller 2 and in the process respectively wipes liquid and dirt off the cleaning roller 2. The liquid and the dirt respectively can flow directly into the disposal channel 14 located adjacent to the wiper device 5 and are ultimately discharged, for example, into a collection container of the wet-cleaning appliance 1.

The functional unit 6 can be removed from the roller cover 12 for servicing or cleaning purposes. After the functional unit 6 has been cleaned, for example, it can be reinstalled into the roller cover 2 by inserting the pivoting axis 7 of the functional unit 6 into the bearing 26, which is realized in the form of a rotary leadthrough. The functional unit 6 is subsequently pivoted, for example, about the bearing 26 such that the counter bearing in the form of the actuating device 9 can likewise be installed into the roller cover 12. The actuating device 9 is subsequently locked. The roller cover 12 can then be connected to the housing 8 of the attachment 21, wherein the functional unit 6 is advantageously displaced into a position corresponding to a mopping mode of the wet-cleaning appliance 1. The functional unit 6 is correspondingly dismounted from the roller cover 12 in reverse order. The roller cover 12 is initially separated from the housing 8 of the attachment 21. The actuating device 7 is subsequently unlocked and the functional unit 6 is pivoted outward. The pivoting axis 7 of the functional unit 6 can then be pulled out of the bearing 26.

Figure 8:
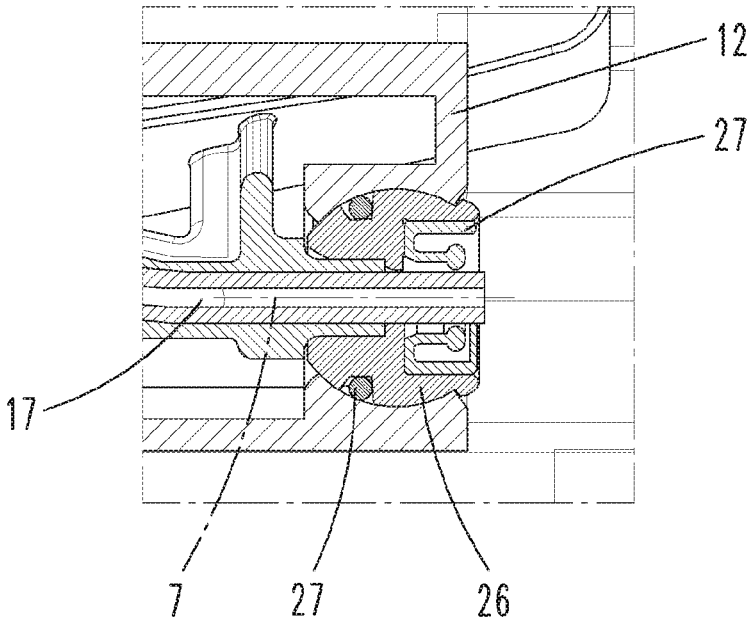
FIG. 8 shows a bearing of the functional unit.

FIG. 8 shows the bearing 26 for receiving the pivoting axis 7 of the functional unit 6. The bearing 26 makes available a rotary leadthrough for the liquid supply line 17 and is sealed by means of sealing elements 27, in this example a rotary shaft seal and an O-ring. In this way, a liquid line of the wet-cleaning appliance 1 can be connected in a fluid-tight manner to the liquid supply line 17, which is pivoted together with the functional unit 6.

Figure 9:
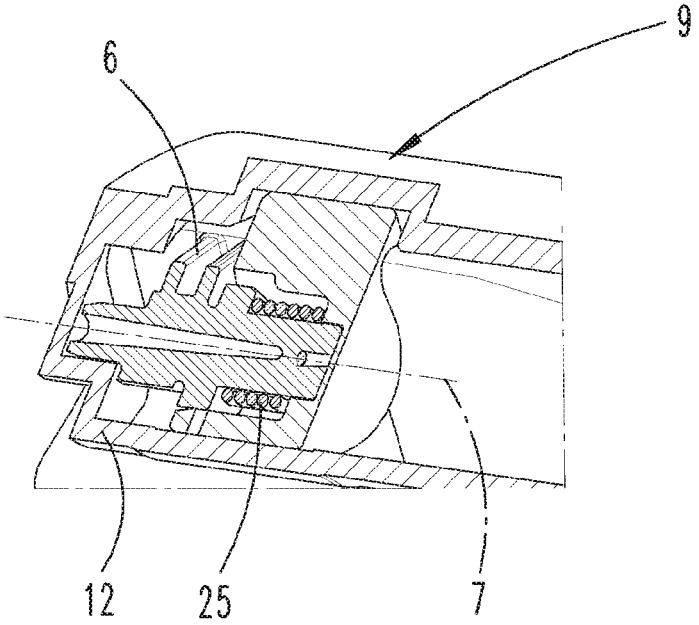
FIG. 9 shows an actuating device for the functional unit.

FIG. 9 shows the actuating device 9, which is arranged on the end of the pivoting axis 7 that lies opposite of the bearing 26. The actuating device 9 comprises a spring 25 that exerts a restoring force upon the illustrated end region of the functional unit 6. The restoring force of the spring 25 acts in the direction of the cleaning roller 2 such that the spring 25 attempts to pivot the functional unit 6 in the direction of the cleaning roller 2.

Figure 10:
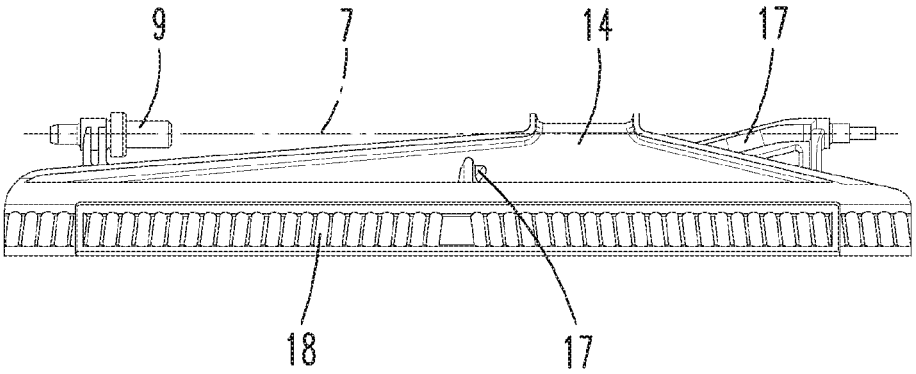
FIG. 10 shows a top view of the functional unit.
Figure 11:
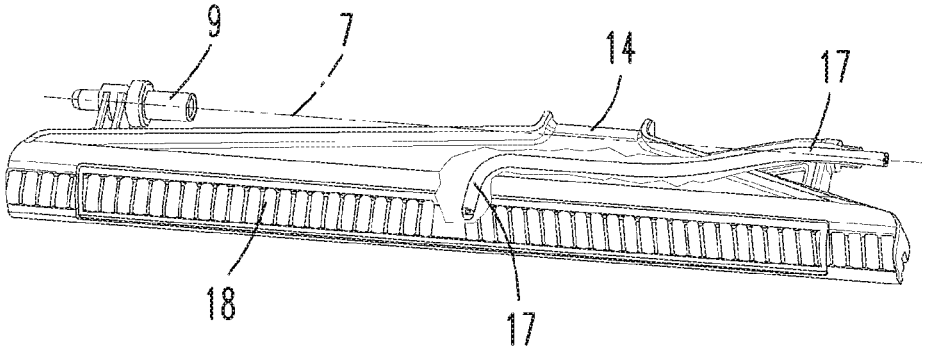
FIG. 11 shows a top view of the functional unit with exposed liquid supply line.
Figure 12:
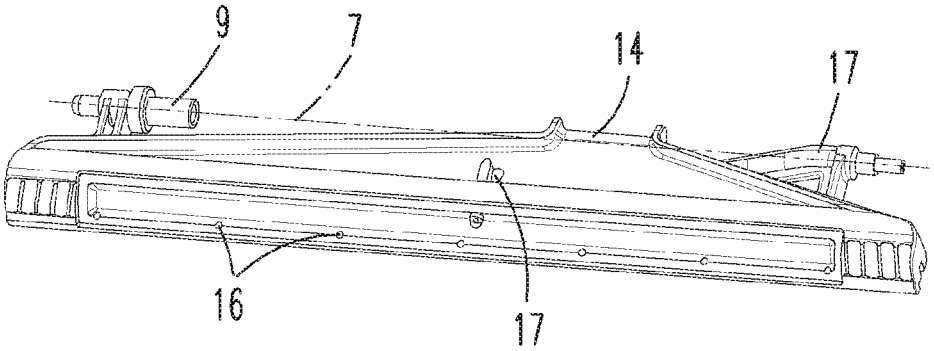
FIG. 12 shows a top view of the functional unit with exposed distribution device.

FIGS. 10-12 show the functional unit 6 in the form of top views, wherein FIGS. 11 and 12 are respectively exposed in different planes or regions.

FIG. 10 particularly shows the distribution device 15, which on the illustrated upper side comprises the air conduction device 18 with a plurality of air conduction ribs. The disposal channel 14, through which liquid and dirt wiped off the cleaning roller 2 can be transported to a collection container, is located underneath the distribution device 15. The air, which is accelerated due to the rotation of the cleaning roller and conducted in the direction of the disposal channel 14 by means of the air conduction device 18, assists in this transport. This figure furthermore shows the actuating device 9, as well as a portion of the liquid supply line 17.

FIG. 11 shows the extent of the liquid supply line 17 to the distribution device 15 of the wetting device 4 within the functional unit 6.

FIG. 12 shows an exposed view in the region of the distribution device 15, wherein the ventilation device is partially sectioned. This figure shows the outlet openings 16 of the distribution device 15, through which liquid can be sprayed on the cleaning roller 2 from the wetting device 4.

According to the invention, the functional unit 6 can be used for wetting the cleaning roller 2 prior to a mopping mode of the wet-cleaning appliance, as well as for regenerating the cleaning roller 2.

During a mopping mode of the wet-cleaning appliance 1, the functional unit 6 usually is completely spaced apart from the cleaning roller by means of the displacement drive 10 such that there is no contact between the wiper device 5 of the functional unit 6 and the surface of the cleaning roller 2. The previously wetted cleaning roller 2 therefore can move freely over a surface to be cleaned. During the mopping mode, dirt removed from the surface to be cleaned is deposited on the surface of the cleaning roller 2, particularly on a cleaning layer of the cleaning roller 2, such that a regeneration of the cleaning roller 2 is suggested after a certain operating period in order to achieve the best possible mopping result.

The opening region 13 of the roller cover 12 is closed by means of the cover element 11 for the regeneration mode such that the cleaning roller 2 is completely encapsulated in the circumferential direction. The displacement of the cover element 11 is realized by means of the cover drive 24. Since the cover drive 24 is functionally connected to the displacement drive 10 of the functional unit 6, the displacement of the cover element 11 simultaneously causes a pivoting motion of the functional unit 6 toward the cleaning roller 2 until the wiper device 5 presses against the cleaning roller 2, wherein the spring of the actuating device 9 additionally ensures the required contact pressure and creates a tolerance compensation for the rotating cleaning roller 2. The cleaning roller 2 is significantly accelerated, i.e. rotated with a rotational speed that is higher than the rotational speed during the mopping mode of the wet-cleaning appliance 1. During the rotation of the cleaning roller 2, liquid and/or dirt are wiped off the cleaning roller 2 and/or spun off the cleaning roller 2. The liquid and/or the dirt are transported to the disposal channel 14, which is arranged directly adjacent to the wiper device 5, and flow from the functional unit 6 in the direction of a collection container under the influence of gravity. The air accelerated due to the rotation of the cleaning roller is additionally conducted in the direction of the disposal channel 14 by means of the air conduction ribs of the air conduction device 18 and thereby assists in respectively transporting away the liquid and the dirt.

In order to once again supply and distribute water on the surface of the cleaning roller 2, the functional unit 6 is displaced toward the cleaning roller 2 to such a degree that the wiper device 5 just barely contacts the fibers of the cleaning layer of the cleaning roller 2, for example with an overlapping region of no more than 1 mm. The cleaning roller 2 is rotated with a rotational speed that is reduced in comparison with the rotational speed during a mopping mode. Liquid that may, if applicable, contain a cleaning additive is then sprayed on the cleaning roller 2, wherein the liquid is under pressure within the wetting device 4 and sprayed out of the outlet openings 16. The wetting device sprays the liquid on the surface of the cleaning roller 2, for example, from a distance of 5 mm to 10 mm. The liquid wets the surface of the cleaning roller 2 and the wiper device 5 presses the liquid between the adjacent fibers of the cleaning layer of the cleaning roller 2. As the rotation of the cleaning roller 2 continues, the liquid is applied bit by bit within one or more complete revolutions of the cleaning roller 2 about the roller axis 3 and distributed until the cleaning roller 2 is completely wetted. Subsequently, the functional unit 6 is moved away from the cleaning roller 2, the roller cover 12 is opened and the cleaning roller 2, which is thusly prepared for a mopping mode, is once again lowered, for example, on the surface to be cleaned. During the subsequent mopping mode, the cleaning roller 2 once again picks up dirt from the surface to be cleaned.

LIST OF REFERENCE SYMBOLS

1 Wet-cleaning appliance
2 Cleaning roller
3 Roller axis
4 Wetting device
5 Wiper device
6 Functional unit
7 Pivoting axis
8 Housing
9 Actuating device
10 Displacement drive
11 Cover element
12 Roller cover
13 Opening region
14 Disposal channel
15 Distribution device
16 Outlet opening
17 Liquid supply line
18 Air conduction device
19 Filler neck
20 Base unit
21 Attachment
22 Shaft
23 Handle
24 Cover drive
25 Spring
26 Bearing
27 Sealing element
r Moving direction

The invention claimed is:

1. A wet-cleaning appliance, comprising:

a cleaning roller that can be rotated about a roller axis, a wetting device for applying a liquid to the cleaning roller, and a wiper device in the form of a wiper lip that is configured to be displaced onto the cleaning roller in order to assist in removing liquid and/or dirt from the cleaning roller and/or to assist in applying liquid to the cleaning roller, wherein the wetting device and the wiper device are parts of a common functional unit, which can be displaced as a whole relative to the cleaning roller from a first operating position into a second operating position and vice versa.

2. The wet-cleaning appliance according to claim 1, wherein the the functional unit is mounted on a housing of the wet-cleaning appliance so as to be pivotable about a pivoting axis arranged parallel to the cleaning roller, wherein the functional unit is particularly subjected to a spring force acting in the direction of the cleaning roller.

3. The wet-cleaning appliance according to claim 1, wherein a displacement drive is assigned to the functional unit and is designed for displacing the functional unit relative to the cleaning roller.

4. The wet-cleaning appliance according to claim 1, wherein the wet-cleaning appliance comprises a displaceable cover element for completing a roller cover, the cover element enclosing the cleaning roller, the wetting device and the wiper device in a shape-corresponding manner in a circumferential direction of the cleaning roller, wherein the cover element is designed for selectively uncovering and/or closing an opening region of the roller cover.

5. The wet-cleaning appliance according to claim 4, wherein the cover element is functionally connected to a displacement drive of the functional unit in such a way that the wiper device and/or the functional unit can be displaced toward the cleaning roller during a displacement of the cover element in the direction of a position in which the cover element closes the roller cover.

6. The wet-cleaning appliance according to claim 1, wherein the wiper device empties into a disposal channel for discharging the liquid into a liquid container.

7. The wet-cleaning appliance according to claim 1, wherein the common functional unit comprises a distribution device with a plurality of outlet openings and/or a liquid supply line for supplying the wetting device with liquid.

8. The wet-cleaning appliance according to claim 7, wherein the distribution device comprises an air conduction device, which is oriented in the direction of the cleaning roller, in order to conduct air in the direction of a disposal channel and to thereby discharge the liquid into a collection container.

9. A method for operating a wet-cleaning appliance in the form of wet mop having a rotatable cleaning roller that can be rotated about a roller axis, a wetting device for applying a liquid to the cleaning roller, and a wiper device in the form of a wiper lip that is configured to be displaced onto the cleaning roller in order to assist in removing liquid and/or dirt from the cleaning roller and/or to assist in applying liquid to the cleaning roller, wherein the wetting device and the wiper device are parts of a common functional unit, which can be displaced as a whole relative to the cleaning roller from a first operating position into a second operating position and vice versa, the method comprising the following steps:

placing the wiper device, which can be displaced relative to the cleaning roller, onto the cleaning roller in order to regenerate the cleaning roller, accelerating the cleaning roller in comparison with a normal rotational speed during a mopping mode of the wet-cleaning appliance, collecting liquid and/or dirt, which is spun off the cleaning roller and/or removed by the wiper device, and transporting the liquid and/or dirt into a collection container.

10. The method according to claim 9, further comprising the steps of applying liquid to the rotatable cleaning roller by means of the wetting device, and displacing the wiper device toward the cleaning roller in order to wet the cleaning roller, wherein the wiper device is spaced apart from the cleaning roller such that the wiper device only contacts a partial end region of fibers of a cleaning layer of the cleaning roller, and wherein the wiper device conducts liquid between the fibers during the rotation of the cleaning roller.

* * * * *